US010337725B2

(12) United States Patent
Tonomura et al.

(10) Patent No.: US 10,337,725 B2
(45) Date of Patent: Jul. 2, 2019

(54) SUPERHEATED STEAM GENERATOR

(71) Applicant: TOKUDEN CO., LTD., Kyoto-shi, Kyoto (JP)

(72) Inventors: Toru Tonomura, Otsu (JP); Masayoshi Kimura, Otsu (JP); Yasuhiro Fujimoto, Kyoto (JP)

(73) Assignee: TOKUDEN CO., LTD., Kyoto-Shi, Kyoto (JP)

( * ) Notice: Subject to any disclaimer, the term of this patent is extended or adjusted under 35 U.S.C. 154(b) by 185 days.

(21) Appl. No.: 15/073,402

(22) Filed: Mar. 17, 2016

(65) Prior Publication Data

US 2016/0273759 A1 Sep. 22, 2016

(30) Foreign Application Priority Data

Mar. 18, 2015 (JP) ..... 2015-055133

(51) Int. Cl.
*F22G 1/16* (2006.01)
*F22B 1/28* (2006.01)
(Continued)

(52) U.S. Cl.
CPC ..... *F22G 1/165* (2013.01); *F22B 1/281* (2013.01); *F22B 1/282* (2013.01); *F22G 5/00* (2013.01); *H05B 6/108* (2013.01)

(58) Field of Classification Search
CPC . F22G 1/165; F22G 5/00; H05B 6/108; F22B 1/281; F22B 1/282
(Continued)

(56) References Cited

U.S. PATENT DOCUMENTS 4,132,884 A * 1/1979 Offermann ..... H05B 3/42 137/341
4,855,552 A 8/1989 Marceau et al.
(Continued)

FOREIGN PATENT DOCUMENTS

CN 101893224 A 11/2010
CN 102628588 A 8/2012
(Continued)

OTHER PUBLICATIONS

European Patent Office, Extended European Search Report Issued in Application No. 16160920.1, dated Oct. 13, 2016, Germany, 5 pages.
(Continued)

*Primary Examiner* — Dana Ross
*Assistant Examiner* — Joe E Mills, Jr.
(74) *Attorney, Agent, or Firm* — Alleman Hall Creasman & Tuttle LLP

(57) ABSTRACT

The present invention intends to highly accurately control a temperature of superheated steam at a high response speed, and provides a superheated steam generator that inductively heats a heating metal body in contact with steam using an induction coil, and thereby heats the steam in contact with the heating metal body to generate superheated steam. In addition, a frequency of an AC power supply connected to the induction coil is 50 Hz or 60 Hz, and a thickness between an induction coil side surface of the heating metal body facing toward the induction coil and a steam contact surface of the heating metal body in contact with the steam is 10 mm or less.

5 Claims, 4 Drawing Sheets

(51) Int. Cl.
*F22G 5/00* (2006.01)
*H05B 6/10* (2006.01)

(58) Field of Classification Search
USPC ..... 392/391, 320, 314; 219/618, 628, 629, 219/630, 400, 648
See application file for complete search history.

(56) References Cited

U.S. PATENT DOCUMENTS

| | | | | |
|---|---|---|---|---|
| 2003/0000945 | A1 | 1/2003 | Pilavdzic et al. | |
| 2007/0102421 | A1* | 5/2007 | Tonomura | H05B 6/02 219/630 |
| 2007/0138162 | A1* | 6/2007 | Tonomura | F28F 5/02 219/469 |
| 2009/0166352 | A1* | 7/2009 | Azuma | H05B 6/108 219/629 |
| 2013/0136435 | A1* | 5/2013 | Graibus | F22B 1/287 392/391 |
| 2016/0273758 | A1* | 9/2016 | Fujimura | H05B 6/108 |

FOREIGN PATENT DOCUMENTS

| | | | |
|---|---|---|---|
| CN | 102798111 | A | 11/2012 |
| CN | 205504953 | U | 8/2016 |
| JP | S63108151 | A | 5/1988 |
| JP | H04230981 | A | 8/1992 |
| JP | 2003021303 | A | 1/2003 |
| JP | 2005517265 | A | 6/2005 |
| JP | 2005325156 | A | 11/2005 |
| JP | 2008075891 | A | 4/2008 |
| JP | 2009045814 | | 3/2009 |
| JP | 2010177069 | | 8/2010 |
| JP | 2012022829 | A | 2/2012 |
| JP | 2012163229 | A | 8/2012 |
| JP | 2013053760 | | 3/2013 |
| JP | 5641578 | B2 | 12/2014 |
| KR | 20120025150 | A | 3/2012 |
| WO | 03001850 | A1 | 3/2003 |

OTHER PUBLICATIONS

Japan Patent Office, Office Action Issued in Japanese Application No. 2015055133, dated Nov. 28, 2017, 8 pages. (Submitted with English Translation of Office Action).
Japanese Patent Office, Office Action Issued in Application No. 2015055133, dated May 15, 2018, 7 pages.
Japanese Patent Office, Decision to Grant a Patent Issued in Application No. 2015055133, dated Jul. 10, 2018, 6 pages.
State Intellectual Property Office of the People's Republic of China, Office Action and Search Report Issued in Application No. 201610133126.5, dated Dec. 29, 2018, 12 pages.

* cited by examiner

SUPERHEATED STEAM GENERATOR

TECHNICAL FIELD

The present invention relates to a superheated steam generator adapted to generate superheated steam by induction heating.

BACKGROUND ART

One such type of superheated steam generator, as disclosed in Patent Literature 1, applies AC voltage to a primary coil wound on an iron core to apply induction current to a conductive tube serving as a secondary coil wound on the iron core, and thereby heats saturated steam flowing through the conductive tube to generate superheated steam.

Also, this superheated steam generator is adapted to detect the temperature of the superheated steam led out of the conductive tube with a temperature detector, and input a control signal corresponding to a deviation between the detected temperature and a target temperature to a voltage control element to control the voltage to be applied to the induction coil. In doing so, the superheated steam led out of the conductive tube is controlled to have a desired temperature.

However, the conventional superheated steam generator is nothing more than an apparatus that, in order to highly accurately control the superheated steam, sets proportional-integral-derivative (PID constants for feedback control (PID control).

CITATION LIST

Patent Literature

Patent Literature 1: Japanese Patent No. 5641578

SUMMARY OF INVENTION

Technical Problem

For this reason, the present inventor is advancing the development of a superheated steam generator capable of highly accurately controlling the temperature of superheated steam at a high response speed without relying only on setting PID constants for PID control, and the present invention primarily intends to highly accurately control the temperature of superheated steam at a high response speed.

Solution to Problem

A superheated steam generator according to the present invention comprises a heating metal body in contact with steam and an induction coil that inductively heats the heating metal body, and thereby heats the steam to generate superheated steam. In addition, a frequency of an AC power supply connected to the induction coil is 50 Hz or 60 Hz, and a thickness between an induction coil side surface of the heating metal body facing toward the induction coil and a steam contact surface of the heating metal body in contact with the steam is 10 mm or less.

In such a configuration, since a 50 Hz or 60 Hz AC voltage is applied to the heating metal body of which the thickness between the induction coil side surface and the steam contact surface is 10 mm or less, a temperature difference between the steam contact surface serving as a steam heating surface of the heating metal body and the induction coil side surface serving as a temperature contact surface of the heating metal body can be reduced, and thereby the temperature of the steam contact surface of the heating metal body can be highly accurately controlled at a high response speed. As a result, the temperature of the superheated steam resulting from the heating by the heating metal body can be highly accurately controlled at a high response speed. This will be described in detail later.

Desirably, the heating metal body is made of a nonmagnetic metal.

In general, nonmagnetic metals have a deep current penetration depth, and are therefore suitable for generating superheated steam not only in a relatively high temperature range but also in a relatively low temperature range.

In a temperature range where the magnetism of a magnetic material remains, a current penetration depth is shallow, and for example, the current penetration depth of carbon steel at 300° C. and 50 Hz is 8.6 mm.

On the other hand, the current penetration depth of Grade 316L Stainless Steel (SUS 316L) is 75.4 mm, and therefore even at the inner surface of the heating metal body having a thickness of 10 mm, a current density equal to 90% or more of a current density at the outer surface can be secured.

Austenitic stainless steel, which is another nonmagnetic metal, is characterized by having high corrosion and heat resistance and a similar deep current penetration, and is therefore suitable for generating superheated steam in a wide temperature range from low temperatures to high temperatures.

Desirably, the superheated steam generator includes a temperature controller that performs feedback control of the temperature of the superheated steam resulting from the heating by the heating metal body such that a deviation with respect to a target temperature falls within a range of less than ±1° C.

Such a configuration makes it possible to easily control the temperature of the superheated steam with high accuracy by taking advantage of the configuration adapted to apply the 50 Hz or 60 Hz AC voltage to the heating metal body having a thickness of 10 mm or less.

The temperature control of the superheated steam is equivalent to controlling the amount of electric power to be supplied to the heating metal body such as a conductive tube, i.e., equivalent to controlling the energy amount of the superheated steam. Given that the energy of the superheated steam is Q, and, for example, a temperature rise value and a superheated steam generation amount when generating the superheated steam from saturated steam are respectively Θ and V, Q can be expressed by $Q \approx \Theta V$. Accordingly, respective PID control constants are changed by a change in Q, i.e., a change in ΘV. For this reason, it is desirable that the temperature controller sets the PID constants depending on a target temperature and a target steam generation amount.

Desirably, the thickness of the heating metal body is set such that a current density at the steam contact surface of the heating metal body is 90% or more of a current density at the induction coil side surface of the heating metal body.

Such a configuration makes it possible to easily perform the control with high accuracy because the ratio of heat generation at the steam contact surface of the heating metal body to that at the induction coil side surface of the heating metal body is approximately 80% or more.

Advantageous Effects of Invention

According to the present invention configured as described, since the 50 Hz or 60 Hz AC voltage is applied to the heating metal body of which the thickness between the induction coil side surface and the steam contact surface is 10 mm or less, the temperature of the superheated steam can be highly accurately controlled at a high response speed without relying only on setting the PID constants for PID control.

DESCRIPTION OF EMBODIMENTS

Figure 1:
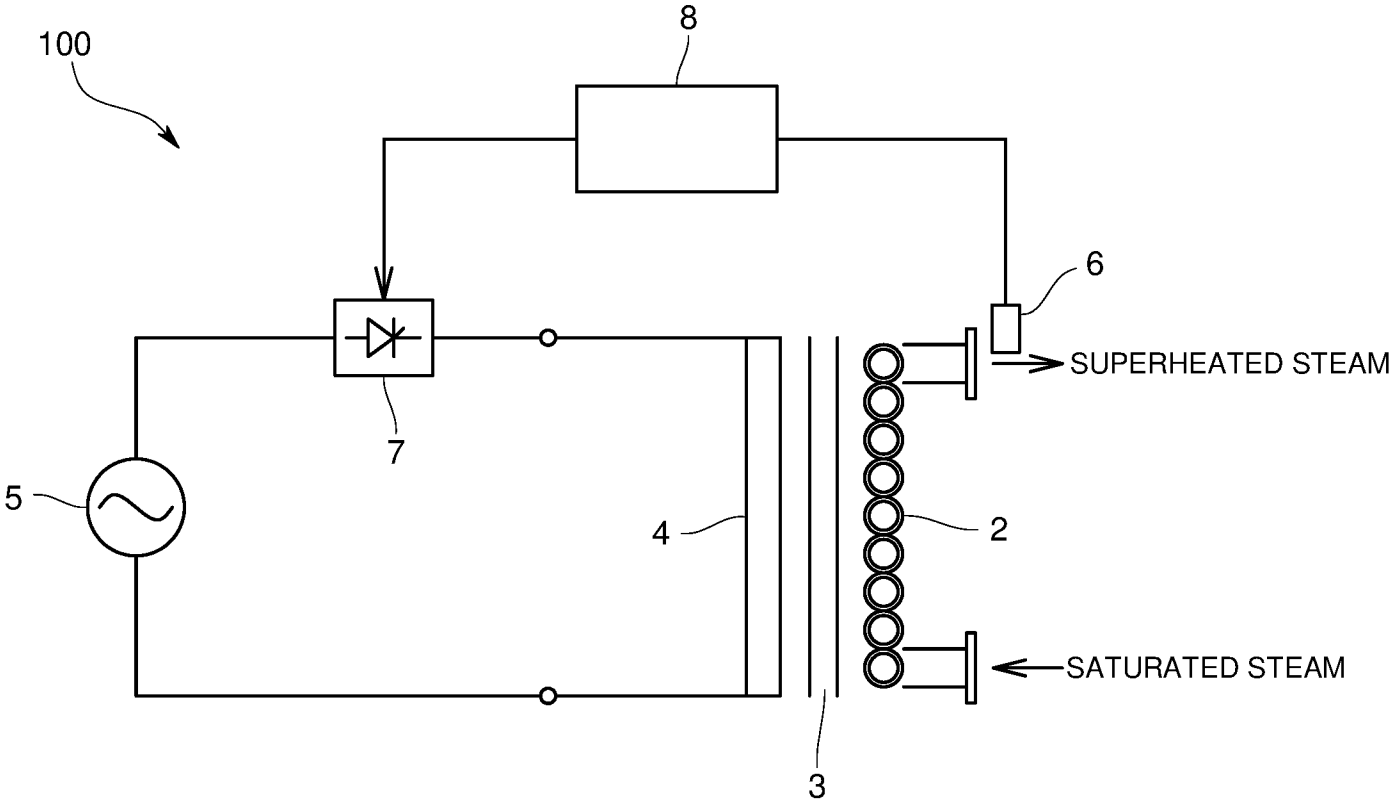
FIG. 1 is a diagram schematically illustrating the configuration of a superheated steam generator according to the present embodiment.

In the following section, one embodiment of a superheated steam generator according to the present invention will be described with reference to the drawings.

A superheated steam generator 100 according to the present embodiment is one that heats externally generated saturated steam with a heating metal body 2 to generate superheated steam having a temperature exceeding 100° C. (200° C. to 2000° C.). Note that the superheated steam generator 100 may include: a saturated steam generator adapted to heat water with a heating metal body to generate saturated steam; and a superheated steam sub-generator adapted to heat the saturated steam generated by the saturated steam generator with a heating metal body to generate superheated steam having a temperature exceeding 100° C. (200° C. to 2000° C.).

The heating metal body 2 is formed with an internal flow path for flowing fluid, and specifically, is a conductive tube. Also, a mechanism adapted to inductively heat the heating metal body 2 includes an iron core 3, and an induction coil 4 as a primary coil wound along the iron core 3. The heating metal body 2 is provided along the primary coil 4 of the induction heating mechanism on an outer or inner circumference of the primary coil 4 or inside the primary coil 4.

Further, the frequency of an AC power supply 5 adapted to apply AC voltage to the induction coil 4 is a commercial frequency of 50 Hz or 60 Hz.

In the superheated steam generator 100 configured as described, by applying the 50 Hz or 60 Hz AC voltage to the induction coil 4, an induction current flows through the heating metal body 2 to generate Joule heat in the heating metal body 2. As a result, the steam flowing through the internal flow path of the heating metal body 2 receives heat from the inner surface of the heating metal body 2, and is thereby heated.

In addition, the conductive tube as the heating metal body 2 in the present embodiment is formed by spirally winding a tube made of stainless steel such as SUS 316L, which is a nonmagnetic metal, and the thickness of the wall of the tube (tube thickness) is adjusted to 10 mm or less. That is, the thickness between the induction coil side surface of the conductive tube 2 (the outer surface of the conductive tube 2) facing toward the induction coil 4 and the steam contact surface in contact with the steam (the inner surface of the conductive tube 2) is adjusted to 10 mm or less. In addition, it is only necessary that the thickness of the tube wall meets the condition that the shortest distance between the induction coil side surface and the steam contact surface is 10 mm or less. Alternatively, it is only necessary that the thickness of the tube wall is 10 mm or less, but not less than a thickness capable of securing a predetermined mechanical strength resistible to superheated steam pressure and thermally expansive deformation. More specifically, it is only necessary that the thickness of the tube wall is more than 0.1 mm in order to resist the superheated steam pressure that reaches 0.3 MPa.

Meanwhile, the current penetration depth $\sigma$ [m] of a heated body (conductive tube) in induction heating is determined by the resistivity $\rho$ [$\Omega\cdot$m] and relative permeability $\mu$ of a metal, and power supply frequency f [Hz], and expressed by the following expression.

$$\sigma=503.3\sqrt{\{\rho/(\mu f)\}}$$

For example, in a state where the conductive tube made of SUS 316L is heated to 800° C., the depth at which the surface current density is reduced to 36.8% thereof, called the current penetration depth, is 96.5 mm at the commercial frequency of 50 Hz, and 6.8 mm at a high frequency of 10,000 Hz.

Figure 2:
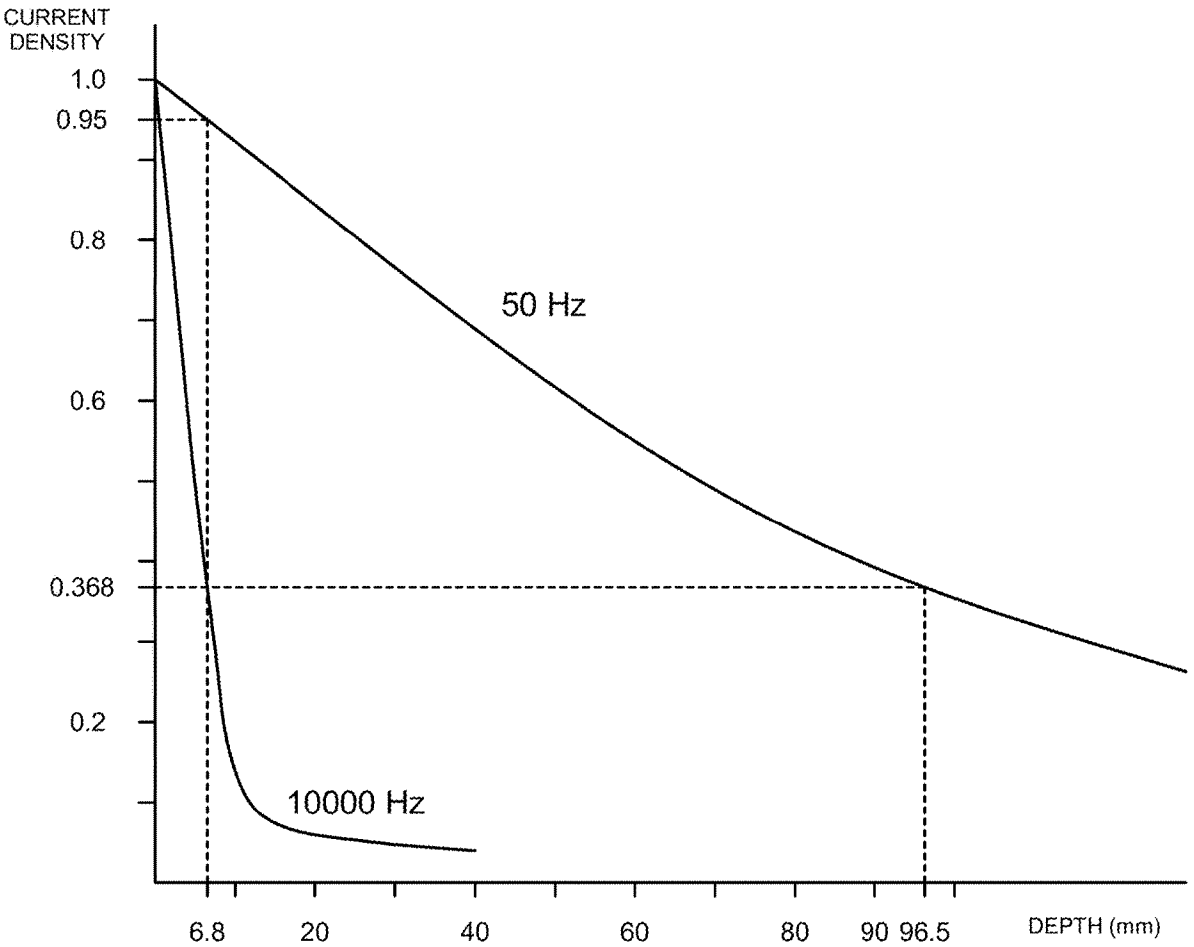
FIG. 2 is a diagram illustrating a current penetration depth when heating SUS 316L to 800° C.

FIG. 2 is a graph representing the current penetration depth of the induction current flowing through SUS 316L at 800° C., and illustrates the relationship between the current density and the depth when the primary coil side surface current density of the conductive tube is defined as 1.0.

For example, in the case where the conductive tube is a tube having a thickness of 6.8 mm, the ratio of the current density at the inner surface to that at the outer surface at 10,000 Hz is 36.8%, and therefore, the ratio of heat generation at the inner surface to that at the outer surface is 13.5%, which corresponds to the square of the current density.

On the other hand, at 50 Hz, the current density at the inner surface of the conductive tube is approximately 95%, and therefore the ratio of heat generation at the inner surface to that at the outer surface is approximately 90%. In addition, in the case where the conductive tube has a thickness of 1.0 mm, the ratio of the current density at the inner surface to that at the outer surface at 50 Hz is 99.9%. Therefore, the thickness of the conductive tube is set such that the ratio of the current density at the inner surface to the outer surface is more than 90% and less than 99.9%.

Since the superheated steam is generated at the inner surface of the conductive tube, at a high frequency of 10,000 Hz, the ratio of heat-generated temperature at the inner surface to heating at the outer surface to be controlled is 0.135 to 1, whereas at a commercial frequency of 50 Hz, the ratio to be controlled is only required to be 0.9 to 1. That is, controllability is better at the commercial frequency at which the temperature difference between the inner surface of the conductive tube and the outer surface of the conductive tube is small.

The superheated steam generator 100 is adapted to detect the temperature of the superheated steam led out of the conductive tube 2 with a temperature detector 6, and input a control signal corresponding to the deviation between the detected temperature and a target temperature to a voltage control element 7 (e.g., a thyristor) to control the AC voltage to be applied to the induction coil 4. A temperature controller 8 specifically performing the control performs feedback control of the temperature of the superheated steam resulting from the heating by the conductive tube 2 such that the deviation with respect to the target temperature falls within a range of less than ±1° C. The temperature controller 8 may include, for example, a processor configured to execute instructions stored in memory (not shown).

The temperature controller 8 is configured to set PID constants depending on the target temperature and target steam generation amount of the superheated steam. Specifically, the temperature controller 8 sets the PID constants using relational data indicating the relationships between superheated steam energy Q and appropriate values of the respective control constants (PID constants).

Figure 3:
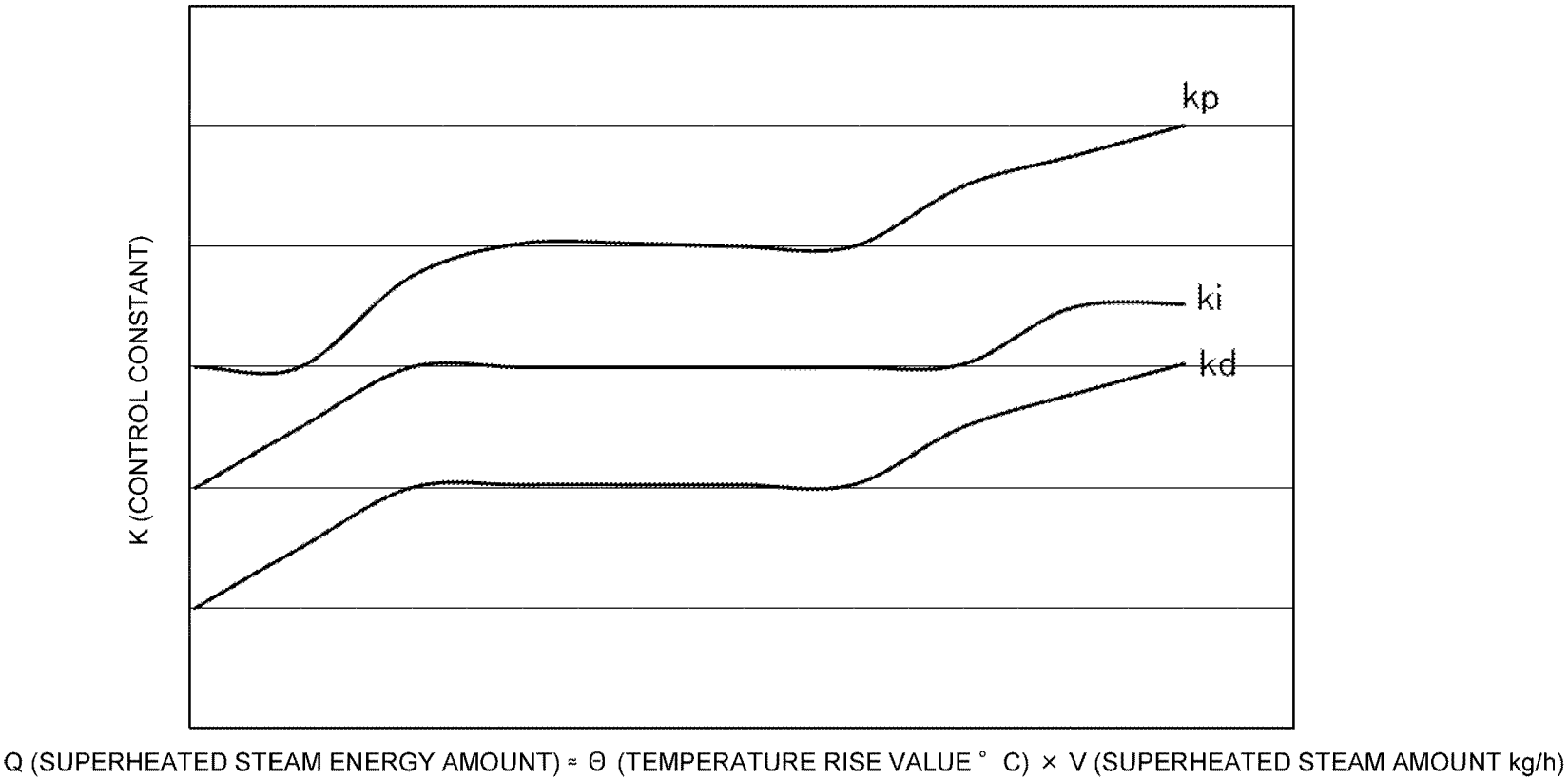
FIG. 3 is a graph illustrating the relationships between superheated steam energy and appropriate values of respective control constants.

Note that the relational data is prepared by acquiring the PID constants appropriate for each of amount and temperature conditions of the superheated steam to be generated, and indicates a relational expression (approximate expression) for each of the proportional constant Kp, integral constant Ki, and differential constant Kd. Specifically, the relational data is as illustrated in FIG. 3.

For example, Kp can be expressed as follows:

$$Kp=a_nQ^n+a_{(n-1)}Q^{(n-1)}+\ldots+a_1Q^1+a_0,$$

where $a_n$ to $a_0$ are constants. In addition, Ki and Kd can also be expressed in the same manner.

The superheated steam energy Q can be calculated from ΘV, where a temperature rise value Θ can be calculated from a setting temperature, and a superheated steam generation amount V can be calculated from a valve opening level of an electric operational valve for setting a superheated steam amount, a supply water amount, or a supply saturated steam amount.

The temperature controller 8 in the present embodiment calculates Θ from the setting temperature of the superheated steam to be generated, calculates V from the valve opening level of the electric proportional valve for controlling the supply saturated steam amount to determine Q, and at the same time, operates Kp, Ki, and Kd to set the control constants.

This function is automatically set (automatically tuned), and therefore, from the start of running, the temperature control is performed using optimum control constants. The running of the superheated steam generator 100 is normally started after setting the temperature Θ and amount V of the superheated steam to be first generated, and performed in a stable load state. As a result, there is no chance that Θ and V are constantly changed to vary a load amount, and therefore it is not necessary to constantly change the control constants. In addition, in the case of a model not having an electric proportional valve, the calculations can be made from a set superheated steam amount or a measured value of a flowmeter adapted to measure the flow rate of the saturated steam supplied, and a measured value of a thermometer adapted to measure the temperature of the saturated steam.

Effects of the Present Embodiment

Since the superheated steam generator 100 configured as described is adapted to apply the 50 Hz or 60 Hz AC voltage to the heating metal body 2 having a thickness of 10 mm or less, the temperature difference between the inner surface of the heating metal body 2 serving as a steam heating surface and the outer surface of the heating metal body 2 serving as a temperature control surface can be reduced, and therefore the temperature of the inner surface of the heating metal body 2 can be highly accurately controlled at a high response speed. Accordingly, the temperature of the superheated steam resulting from the heating by the heating metal body 2 can be highly accurately controlled at a high response speed.

In particular, since in the configuration adapted to apply the 50 Hz or 60 Hz AC voltage to the heating metal body having a thickness of 10 mm or less, the PID constants are set depending on the target temperature and the target steam generation amount, the feedback control of the temperature of the superheated steam can be easily performed with high accuracy such that the deviation with respect to the target temperature falls within a range of less than ±1° C.

Variations of the Present Invention

Note that the present invention is not limited to the above-described embodiment.

The material of the conductive tube is not limited to SUS 316L but may be a material such as an INCONEL alloy (Japanese Industrial Standard (JIS) alloy No. NCF601). In a superheated steam generator using the Inconel alloy, in the case of a superheated steam amount of 200 kg/h and a maximum steam temperature of 1200° C., the thickness of the conductive tube resistible to superheated steam pressure and thermally expansive deformation is 3 mm.

Figure 4:
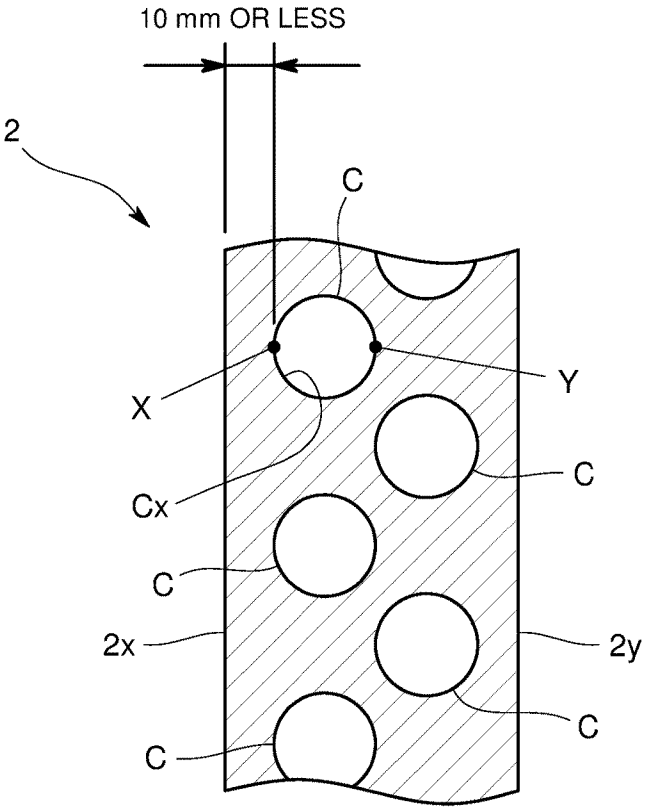
FIG. 4 is a cross-sectional view illustrating a variation of a heating metal body.

Also, the heating metal body is not limited to the conductive tube, but, for example, as illustrated in FIG. 4, may be a block body inside which an internal flow path for flowing water or steam is formed. In this case, it is configured so that a distance between one surface 2*x*, which is an induction coil side surface of the heating metal body 2, and an inner surfaced Cx, which is a steam contact surface of the internal flow path C adjacent to the one surface 2*x*, is 10 mm or less. Note that the distance is the shortest distance (see FIG. 4) to a one surface 2*x* side part of the inner surface Cx. In addition, the distance may be set as the shortest distance to the other surface 2*y* side part (Y) of the inner surface Cx, or as the shortest distance between the one surface 2*x* side part (X) and the other surface 2*y* side part (Y). Further, in order to efficiently heat the whole of the steam passing through the internal flow path C, the shortest distance to the inner surface Cx of the internal flow path C most distant from the one surface 2*x* may be set to 10 mm or less. Also, by superposing multiple metal body elements, the internal flow path may be formed therebetween.

In addition, it will be appreciated that the present invention is not limited to any of the above-described embodiment and variations, but can be variously modified without departing from the scope thereof.

LIST OF REFERENCE CHARACTERS

100 Superheated steam generator
2 Heating metal body (conductive tube)
3: Iron core
4: Induction coil
5: AC power supply
6 Temperature detector
7 Voltage control element
8 Temperature controller

The invention claimed is:

1. A superheated steam generator, comprising:

a heating metal body in contact with steam;

an induction coil that inductively heats the heating metal body, and thereby heats the steam to generate superheated steam; and a temperature controller that includes a processor configured to execute instructions stored in memory to perform feedback control of a temperature of the superheated steam resulting from the heating by the heating metal body such that a deviation with respect to a target temperature falls within a range of less than ±1° C., wherein a frequency of an AC power supply connected to the induction coil is 50 Hz or 60 Hz, a thickness of the heating metal body from a first surface of the heating metal body facing toward the induction coil to a second surface of the heating metal body in contact with the steam is 10 mm or less, and the temperature controller calculates a superheated steam energy Q from an equation Θ×V, calculates a temperature rise value Θ from a setting temperature, calculates a superheated steam generation amount V from a valve opening level of a valve for setting the superheated steam generation amount V or from a supply water amount or a supply saturated steam amount, and sets proportional-integral-derivative (PID) constants using the calculated superheated steam energy Q and relationship data indicating a relationship between the superheated steam energy Q and the PID constants.

2. The superheated steam generator according to claim 1, wherein the heating metal body is made of a nonmagnetic metal.

3. The superheated steam generator according to claim 1, wherein the thickness of the heating metal body is set such that a current density at the second surface of the heating metal body is 90% or more of a current density at the first surface of the heating metal body.

4. The superheated steam generator according to claim 1, wherein the heating metal body is a conductive tube through which the steam flows.

5. The superheated steam generator according to claim 1, wherein the temperature controller is configured to perform the feedback control such that the temperature of the superheated steam is 200° C. to 2000° C.

* * * * *